United States Patent [19]

Sanford et al.

[11] 4,406,295

[45] Sep. 27, 1983

[54] CIGARETTE FILTER

[75] Inventors: Robert A. Sanford, Prospect; Andrew McMurtrie, Louisville, both of Ky.

[73] Assignee: Brown & Williamson Tobacco Corporation, Louisville, Ky.

[21] Appl. No.: 349,232

[22] Filed: Feb. 16, 1982

[51] Int. Cl.[3] ..... A24D 3/04

[52] U.S. Cl. ..... 131/336; 131/340

[58] Field of Search ..... 131/336, 340, 198 R, 131/198 A

[56] References Cited

U.S. PATENT DOCUMENTS

| | | | |
|---|---|---|---|
| 3,910,288 | 10/1975 | Hammersmith et al. | 131/336 |
| 4,256,122 | 3/1981 | Johnson | 131/336 |
| 4,343,319 | 8/1982 | Cantrell | 131/336 |

*Primary Examiner*—Vincent Millin

*Attorney, Agent, or Firm*—Charles G. Lamb

[57] ABSTRACT

A filter for a cigarette includes a porous filter rod circumscribed by a non-porous or air impermeable wrapper, and ventilating air grooves embedded in the wrapped filter rod which extend from one end of the filter rod a preselected distance generally longitudinally of the filter rod. An air permeable tipping material circumscribes the wrapped filter rod which provides a path therethrough for ventilating air flow only into the grooves. The walls of each of the grooves defined by the wrapper, in one form of the invention, is permeable to air over virtually its entire length, and in another form of the invention is permeable to air flow only adjacent the mouth end of the filter. Under certain smoking conditions most, if not all of the ventilating air will flow from the grooves into the smoker's mouth through the open end of the grooves at the mouth end of the filter rod. Under certain other smoking conditions, at least a part of the ventilating air will pass through the air permeable walls, or portions thereof, of the grooves and into the filter rod wherein it co-mingles with and dilutes the smoke flowing therethrough.

24 Claims, 17 Drawing Figures

CIGARETTE FILTER

BACKGROUND OF THE INVENTION

1. Field of the Invention

This invention relates to a filter for cigarettes. In one aspect it relates to a filter with novel ventilating means. In another respect the invention relates to a filter for a ciagarette having flow directing grooves formed therein for directing ventilating air to the mouth end of the filter and concurrently delivering filtered smoke through the filter to the mouth end of the filter. In yet another aspect, the present invention relates to a cigarette filter of the class described wherein, under certain smoking conditions, at least some ventilating air passes from the flow directing grooves and into the filter to co-mingle with and dilute the smoke flowing in the filter before it reaches the mouth end of the filter.

2. Description of the Prior Art

It is well known in the art to add filters to cigarettes wherein the filters are provided with ventilation means to bring ambient air into the filter to dilute the smoke stream passing therethrough. The dilution of the smoke stream reduces the quantity of smoke particulates as well as the gas phase components which are delivered to the smoker's mouth. A number of means have been proposed and are utilized for introducing ventilating air into the cigarette. For example, the wrapper for the tobacco of a cigarette can be made from a porous material which allows for introduction of air along the entire length of the cigarette where it mixes with the smoke stream passing therethrough thereby diluting the smoke in the stream. Also the cigarette wrapper may be perforated at selected locations along the length of the cigarette which provides ports in the cigarette through which ventilating air enters. Even further, it is known to perforate the wrapper of the filter of a filtered cigarette to allow ventilating air to enter the filter and dilute the smoke stream passing through the filter. There have also been a number of suggestions for incorporating grooves within the filter of a filter cigarette to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations. The ventilating air enters into the filter element and the grooves through the perforations in the tipping paper and progresses to the smoker's mouth. And, U.S. Pat. No. 4,256,122 teaches a filter for a cigarette which includes grooves extending longitudinally along the outer surface of a filter rod circumscribed by a non-porous plug wrap and the rod and wrap are enclosed with ventilating tipping paper so that in use only ventilating air travels down the grooves and only smoke travels through the filter. Other patents which relate to cigarette filters having grooves circumscribing the filter element for the introduction of ventilating air into the cigarette filter include U.S. Pat. No. 3,577,995; U.S. Pat. No. 3,752,347; U.S. Pat. No. 3,490,461; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; U.S. Pat. No. 4,256,122 and U.S. Pat. No. 3,910,288.

SUMMARY OF THE INVENTION

The present invention advantageously provides a straightforward arrangement of a filter for a cigarette which in one form achieves essentially normal cigarette pressure drop with low to moderate efficiency filters. The present invention further provides a cigarette filter for lowering tar predominantly by ventilation while also providing filtration of the cigarette smoke. The present invention even further provides a filter ventilation system for a cigarette utilizing grooves in the filter plug extending from the ventilating air perforations in the tipping paper to the mouth end of the filter. The present invention, in addition, provides a grooved cigarette filter wherein the walls of the grooves are air permeable over virtually the entire length of the grooves and the rest of the peripherial surface of the filter is air impermeable.

The present invention also provides a grooved cigarette filter wherein a portion of the walls of the grooves are air permeable in a location generally adjacent the mouth end of the filter while the remaining area of the grooves, as well as the peripherial surface of the filter are air impermeable.

More particularly, the present invention provides a filter for a cigarette comprising a porous filter rod of generally cylindrical configuration; an air impermeable wrapper extending longitudinally along the filter rod from one end thereof to the other and circumscribing the filter rod leaving flow-through opposing ends of the filter rod, the wrapping being formed with at least one groove embedded into the filter rod, the at least one groove being open at one end of the filter rod and extending therefrom in a generally longitudinal direction of the filter rod for a distance less than the length of the filter rod; air permeable means formed in the wall of the at least one groove defined by the wrapper over virtually the entire length of the groove, the peripherial surface of the wrapper remaining air impermeable; and, tipping material extending longitudinally of and circumscribing the wrapped filter rod, the tipping material being air permeable over at least a portion of the at least one groove.

The present invention further particularly provides a filter for a cigarette comprising a porous filter rod of generally cylindrical configuration, an air impermeable wrapper extending longitudinally along the filter rod from one end thereof to the other and circumscribing the rod leaving flow-through opposed ends of the filter rod, the wrapper being formed with at least one groove embedded into the filter rod, open at the mouth end of the filter rod and extending therefrom in a generally longitudinal direction of the filter rod for a distance less than the length of the filter rod, air permeable means formed in the wall of the at least one groove defined by the wrapper in a region generally adjacent the open end of said at least one groove at the mouth end of the filter rod, the remaining area of the at least one groove and the peripherial surface of the wrapper being air impermeable, and tipping material extending longitudinally of and circumscribing the wrapped filter rod, the tipping material being air permeable over at least a portion of the at least one groove.

BRIEF DESCRIPTION OF THE DRAWINGS

These and other features of the present invention will become even more clear upon reference to the following description and in conjunction with the accompanying drawing wherein like numbers refer to like parts throughout the views and in which.

DESCRIPTION OF THE PREFERRED EMBODIMENT

Figure 1:
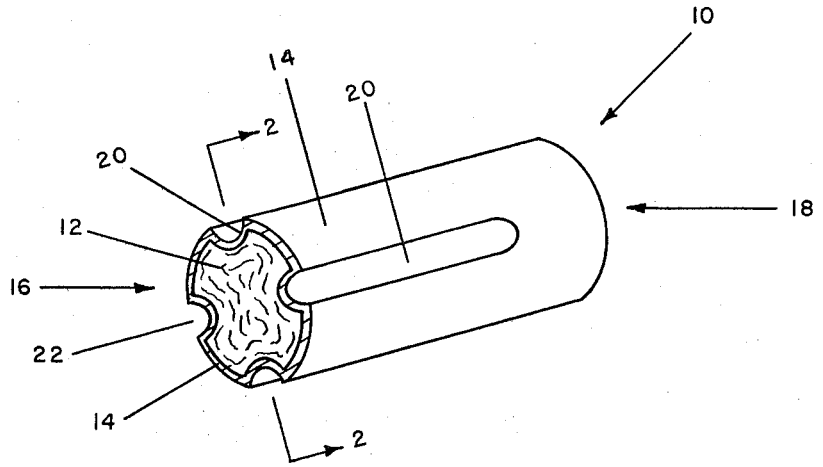
FIG. 1 is a perspective view of a cigarette filter of the present invention with the tipping material removed to more clearly show the various details.
Figure 2:
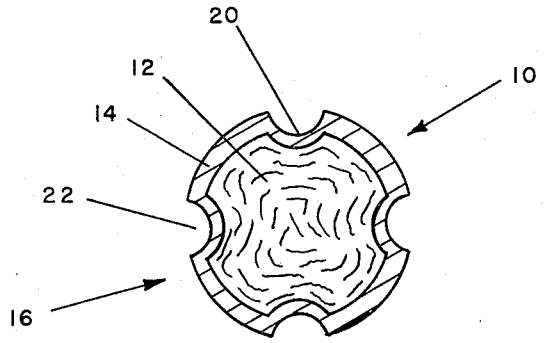
FIG. 2 is an enlarged end view taken in the direction of arrows 2—2 in FIG. 1.
Figure 3:
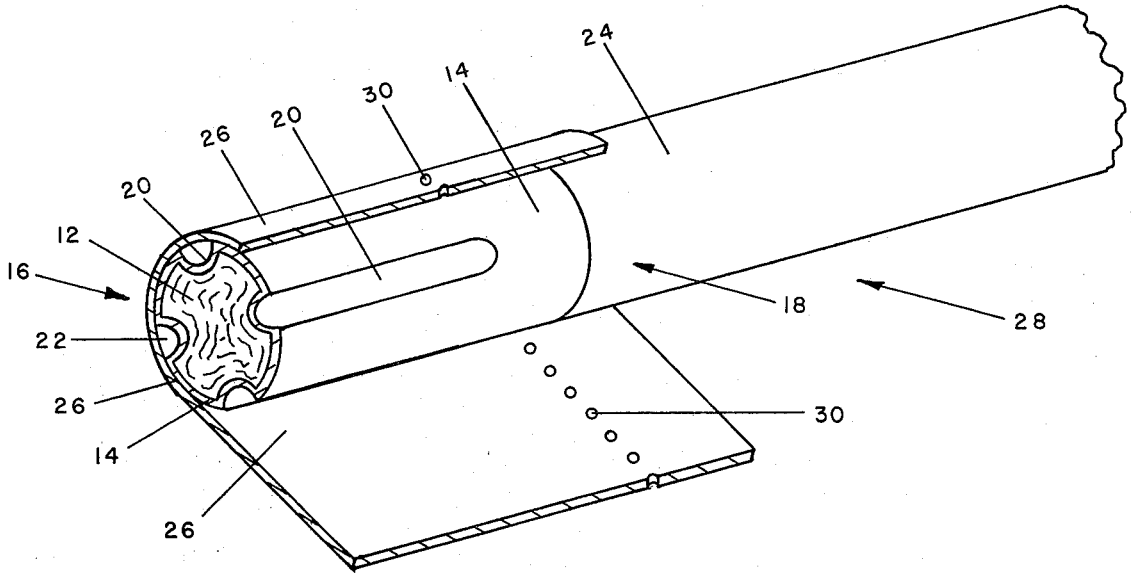
FIG. 3 is a perspective view of a cigarette incorporating the filter of FIG. 1 with the tipping material partially unwrapped.

FIGS. 1, 2 and 3 illustrate a cigarette filter, generally denoted as the numeral 10, incorporating the features of the present invention. The cigarette filter 10 is shown as comprising a generally cylindrically shaped filter rod 12 and a circumscribing wrapper 14. The wrapper 14 extends longitudinally along the filter rod 12 from one end 16 of the filter rod to the other end 18 thereof so that the filter rod ends 16 and 18 are in mutual flow through relationship.

The filter rod 12 is fabricated of a porous material such as, for example, fibrous or foamed cellulose acetate, or any other material suitable for filtering cigarette smoke.

The cigarette filter 10 further comprises a plurality of grooves 20 formed in the wrapper 14 and embedded into the filter rod 12. Each of the grooves 20 is open as designated by the numeral 22 at the mouth end 16 of the filter rod 12, and extends therefrom in a generally longitudinal direction of the filter rod 12 for a distance less than the length of the filter rod. FIGS. 1, 2 and 3 illustrate four such grooves 20 equally spaced from each other about the circumference of the filter rod 12.

In the manufacture of the cigarette 10, the wrapper 14 can be integrally formed with the filter rod 12 or be a separate component. The wrapped filter rod 12, for example, can be placed in a mold or other treating means for depressing the wrapper 14 at selected locations thus embedding the wrapper 14 into the filter rod 12 and forming the grooves 20. One such method is commonly referred to in the cigarette manufacturing industry as a heat molding technique.

The embedded portions of the wrapper 14 defining the walls of the groove 20 may or may not be permeable to air as discussed hereinafter in regard to FIGS. 4, 5 and 6, while the remaining or peripherial area of the wrapper 14 outside the grooves is impermeable to air.

Figure 4:
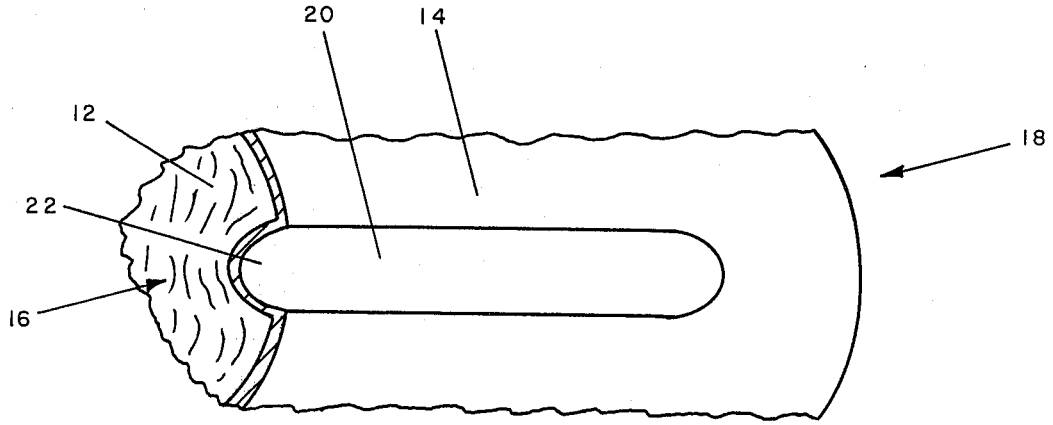
FIG. 4 is an enlarged perspective view of a portion of the filter of FIG. 1 illustrating an advantageous embodiment of the ventilating groove thereof.

To this end, as illustrated in FIG. 4, the wrapper 14 can be fabricated of a porous material such as, for example, cellulose acetate. The remaining or peripherial area of wrapper 14 outside the grooves is treated in a manner to seal the pores of the porous material to make it impermeable to air while the embedded portions of the wrapper which define the walls of the grooves 20 are not so treated and, thus, remain porous so that the grooves are permeable to air over substantially their entire length. One such treatment is to, for example, apply heat to the wrapper to heat seal the porous material. Another effective treatment is to coat the wrapper with a water insoluble solution or material such as, for example, ethylcellulose or a water soluble material such as, for example, sodium CMC or methyl cellulose for sealing the porous material. One method for applying the coating just to the peripherial area of the wrapper 14 is with a gravure roller.

Figure 5:
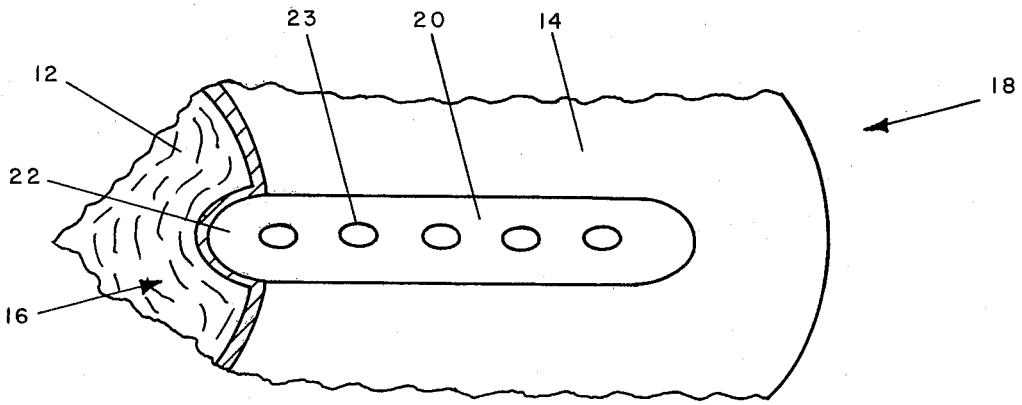
FIG. 5 is an enlarged perspective view of a portion of the filter of FIG. 1 illustrating another advantageous embodiment of the ventilating groove thereof.

Alternatively, as shown in FIG. 5, the wrapper 14 can be fabricated of a porous material, such as, for example, cellulose acetate and the entire area of the wrapper 14 including the embedded portions of the wrapper defining the walls of the grooves 20, as well as the peripherial areas between adjacent grooves 20, is treated in a manner to seal the pores of the porous material rendering it air impermeable as discussed hereinabove. After the entire surface of the wrapper is treated, an array of small air flow-through apertures 23 are punched, or otherwise formed through the thickness of the walls of the grooves defined by the embedded portions of the wrapper over substantially the entire length of the grooves to define the air permeable means in the grooves.

With continued reference to FIG. 5, yet another alternative is to fabricate the wrapper 14 of a non-porous material and to punch, or otherwise form the array of small air flow-through apertures 23 through the thickness of only the walls of the grooves defined by the embedded portions of the wrapper 14.

Figure 6:
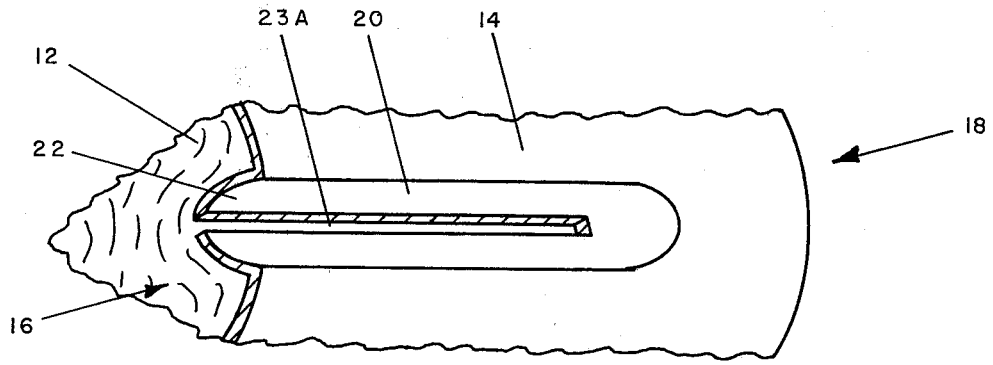
FIG. 6 is an enlarged perspective view of a portion of the filter of FIG. 1 illustrating a further advantageous embodiment of the ventilating groove thereof.

With reference to FIG. 6, the wrapper 14 can be fabricated of either a porous material and treated as discussed above to render it air impermeable, or it can be fabricated of an air impermeable material. Instead of forming flow-through apertures 23 through the groove walls, in this embodiment, slits 23*a* are formed through the wrapper in the grooves. The slits 23*a* are shown as being open at one end to the mouth end 16 of the filter and extending therefrom generally longitudinally of the groove for substantially the entire length of the groove.

As for FIG. 6, the wrapper 14, including the embedded portions defining the walls of the groove 20, is impermeable and the flow-through portion of the groove 20 is identified as a slit 23*a* extending from the end 16 substantially the entire length of the groove 20. Means for treating the wrapper 14 and making the slit 23*a* may be accomplished in the same manner as the discussion hereinbefore in relation to FIG. 5.

As can be seen in FIG. 3, the filter rod 12 is attached to a tobacco column 24 with a tipping material 26 which circumscribes the wrapper covered filter rod 12 to form a filtered cigarette 28. The tipping material 26 is air permeable in a zone thereof which overlays the grooves 20 so that ventilating air will flow through it into the grooves 20. Preferably, the tipping material 26 is air permeable only near the closed ends of the grooves 20, i.e. that end of each groove opposite its open end 22 at the mouth end 16 of the filter rod 12. To accomplish this, the tipping material 26 is illustrated as having small flow-through ventilating air perforations 30 which communicate with the grooves 20 near the closed end of the grooves. As a manufacturing expedient, the air perforations 30 can be arranged in a spaced apart circumferential array around the wrapped filter rod in which case some of the perforations may overlay the wrapped filter rod in the area between adjacent grooves 20. However, ventilating air will flow only into the grooves 20 because the wrapper 14 outside of the grooves 20 is air impermeable.

When a smoker draws on the mouth end 16 of the filter 10 while smoking the cigarette 28, ventilating air is drawn through the ventilating perforations 30 in the tipping material 26 and travels along the groove 20 directly to the open end 22 of the groove 20 at the mouth end 16 of the filter rod 12. If, however one or more of the open ends 22 of the grooves 20 becomes blocked, the ventilating air in the blocked groove will pass from the blocked groove through the appropriate flow-through means in the wall of the blocked groove and into the filter rod 12 where it co-mingles with and dilutes the smoke flowing through the filter rod from the tobacco column. Even if some of the grooves become blocked resulting in the ventilating air in the blocked groove flowing into the filter rod 12, as discussed immediately above, the ventilating air flowing in the remaining unblocked grooves travels therethrough directly to the open end 22 of the unblocked grooves at the mouth end 16 of the filter rod 12.

Figure 7:
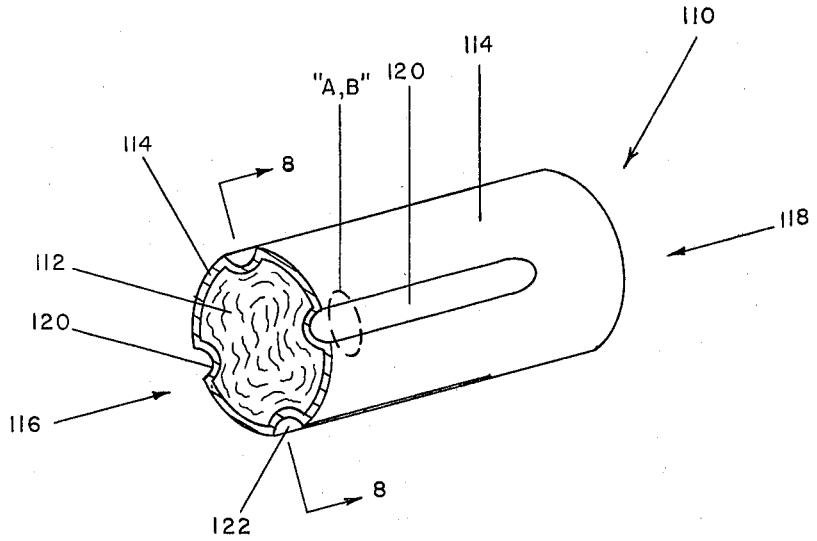
FIG. 7 is an enlarged perspective view of a cigarette filter of the present invention with the tipping material removed to more clearly show the various details.
Figure 8:
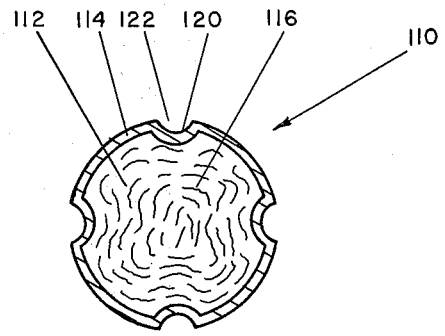
FIG. 8 is an enlarged cross-sectional end view taken in the direction of arrows 8—8 in FIG. 7.
Figure 9:
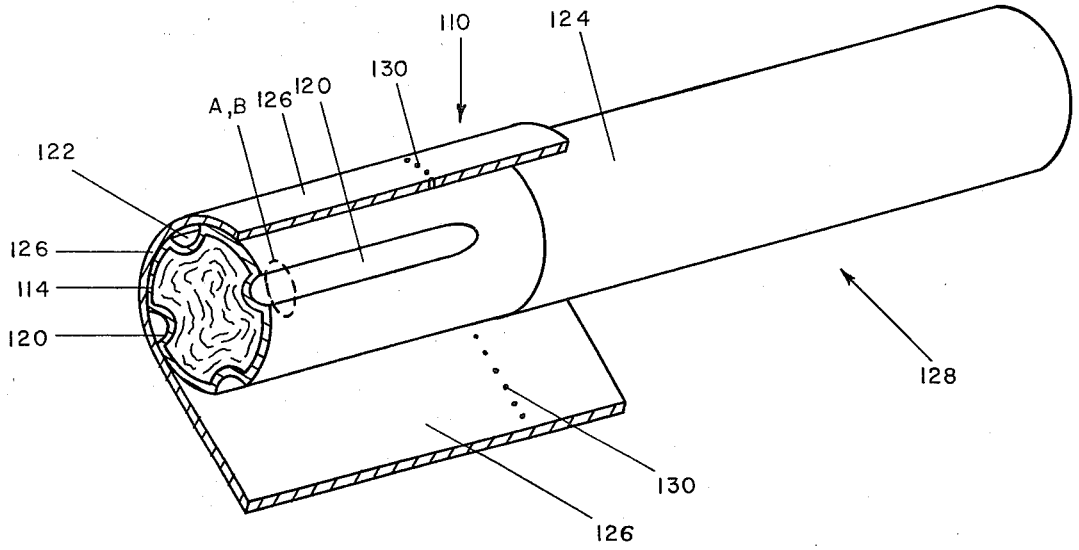
FIG. 9 is an enlarged perspective view of a cigarette incorporating the filter of FIG. 7 with the tipping material partially unwrapped.

FIGS. 7, 8 and 9 illustrate a cigarette filter, generally denoted as the numeral 110, incorporating the features of the present invention. The cigarette filter 110 is shown as comprising a generally cylindrically shaped filter rod 112 and a circumscribing wrapper 114. The wrapper 114 extends longitudinally along the filter rod 112 from one end 116 of the filter rod to the other end 118 thereof so that the filter rod ends 116 and 118 are in mutual flow-through relationship.

The filter rod 112 is fabricated of a porous material such as, for example, fibrous or foamed cellulose acetate, or any other material suitable for filtering cigarette smoke.

The cigarette filter 110 further comprises a plurality of grooves 120 formed in the wrapper 114 and embedded into the filter rod 112. Each of the grooves 120 is open at one of its ends 122 at, the mouth end 116 of the filter rod 112, and extends therefrom in a generally longitudinal direction of the filter rod 112 for a distance less than the length of the filter rod. FIGS. 7, 8 and 9 illustrate four such grooves 120 equally spaced from each other about the circumference of the filter rod 112.

In the manufacture of the cigarette 110, the wrapper 114 can be integrally formed with the filter rod 112 or it can be a separate component. The wrapped filter rod 112, for example, is placed in a mold, or other treating means for depressing the wrapper 114 at selected locations, thus, embedding the wrapper 114 into the filter rod 112 and forming the grooves 120. One such method is commonly referred to in the cigarette manufacturing industry as a heat molding technique.

The embedded portions of the wrapper 114 defining the wall of each of the grooves 120 are permeable to air only in a region near or generally adjacent the mouth end 116 of the filter 110, while the remaining area of the groove wall is air impermeable, and the peripherial area of the wrapper 114 outside the grooves is also air impermeable.

Figure 10:
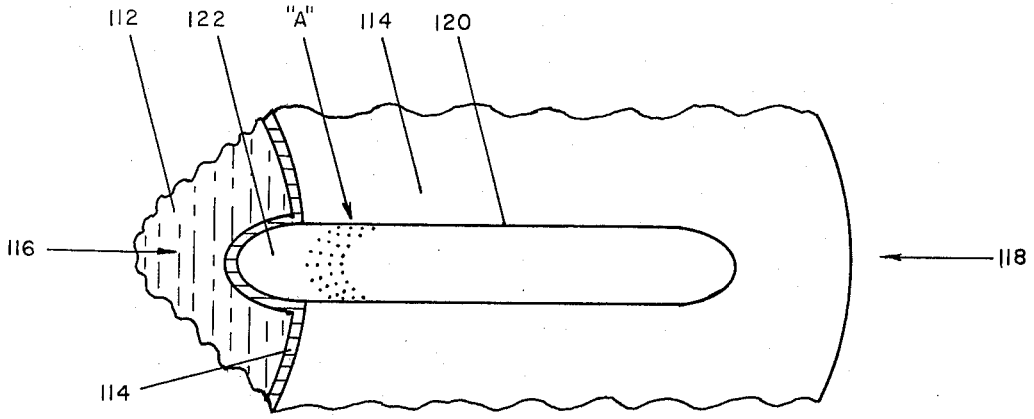
FIG. 10 is an enlarged perspective view of a portion of the filter of FIG. 7 illustrating an advantageous embodiment of the ventilating groove thereof.
Figure 11:
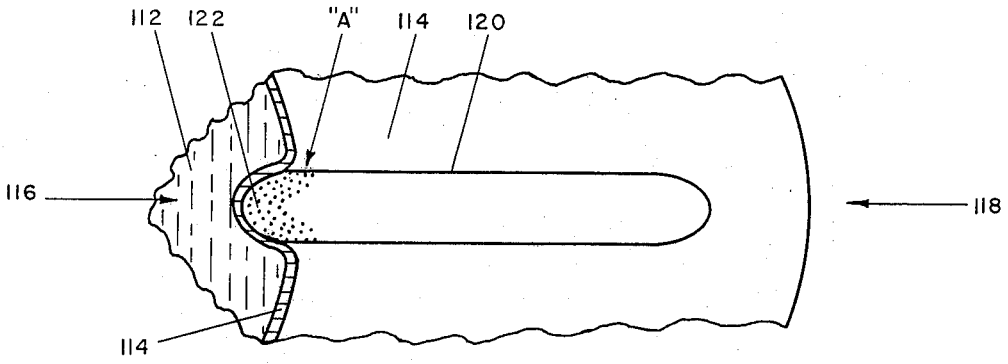
FIG. 11 is an enlarged perspective view of a portion of the filter of FIG. 7 illustrating another advantageous embodiment of the ventilating groove thereof.

To this end, as illustrated in FIGS. 10 and 11, the wrapper 114 can be fabricated of a porous material such as, for example, cellulose acetate. All of the wrapper 114 except for the region generally denoted by the letter "A" at the mouth end 116 of the filter 110 in each of the grooves 120 is treated in a manner to seal the pores of the porous material to make it impermeable to air flow and leaving only the untreated region "A" in each of the grooves porous and, thus, permeable to air flow.

As illustrated in FIG. 10, the porous region "A" in each groove 120 is immediately adjacent the mouth end 116 of the filter 110 and covers an area approximately corresponding to the area of a circle having a diameter of about 0.06 filter diameters. For example, in conventionally sized cigarette filters which have a diameter of approximately 8 mm, it has been determined that a porous region "A" covering an area of approximately 0.2 square mm works well to provide a flow-path for ventilating air from the grooves 120 into the filter rod 112 under certain smoking conditions while preventing the flow of significant amounts of smoke from the filter rod into the grooves under other smoking conditions.

As illustrated in FIG. 11, the porous region "A" in each groove 120 is spaced from the mouth end 116 of the filter a distance generally corresponding to approximately equal to about one-fourth to about one-half filter diameters and covers an area approximately equal to the area of a circle having a diameter of about 0.06 filter diameters. In conventionally sized cigarette filters, which have a diameter of approximately 8 mm, it has been determined that a porous region "A" spaced from approximately 2 mm to approximately 4 mm from the mouth end 116 of the filter and covering an area of approximately 0.2 square mm works well to provide a flow-path for ventilating air from the grooves 120 into the filter rod 112 under certain smoking conditions while preventing the flow of significant amounts of smoke from the filter rod into the grooves 120 under other smoking conditions. One such treatment for sealing the pore of the porous wrapper material is to, for example, apply heat to the locations to be made air impermeable to heat seal the pores. Another effective treatment is to coat the locations to be made air impermeable with a water insoluble solution or material such as, for example, ethylcellulose which seals the pores or a water-soluble material such as, for example, sodium CMC, or methyl cellulose.

Figure 12:
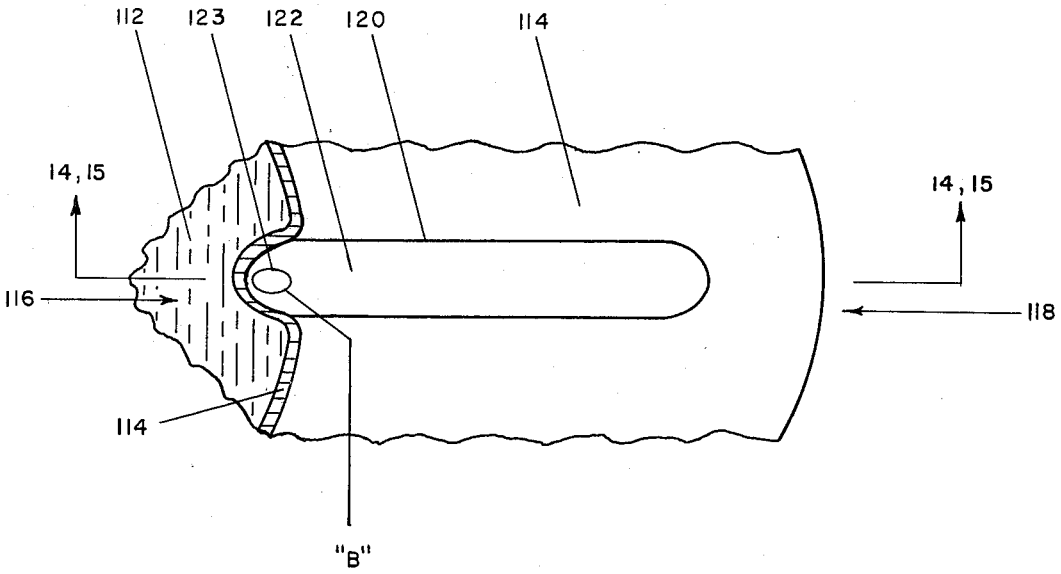
FIG. 12 is an enlarged perspective view of a portion of the filter of FIG. 7 illustrating a further advantageous embodiment of the ventilating groove thereof.
Figure 13:
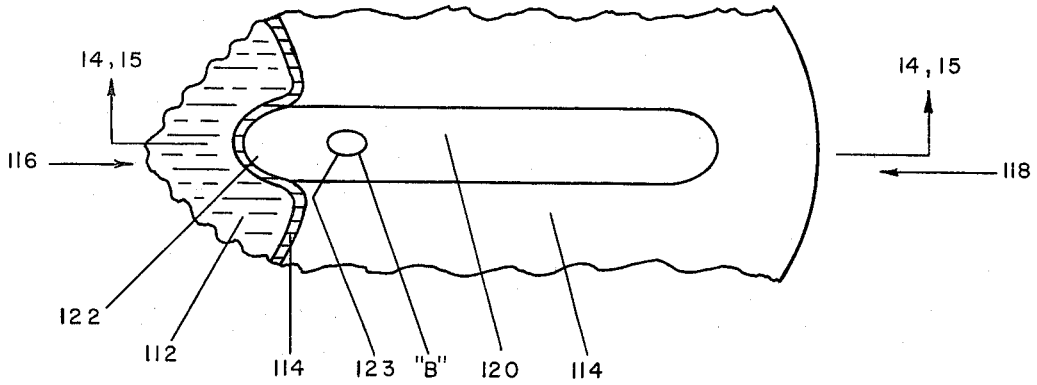
FIG. 13 is an enlarged perspective view of a portion of the filter of FIG. 7 illustrating yet a further advantageous embodiment of the ventilating groove thereof.

Alternatively, as shown in FIGS. 12 and 13, the wrapper 114 can be fabricated of either a non-porous material or of a porous material, such as, for example, cellulose acetate. When the wrapper 114 is fabricated of a porous material the entire area of the porous wrapper material 114, including the embedded portions of the wrapper 114 defining the walls of the grooves 120, is treated in a manner to seal the pores of the porous filter wrapper 114 as described above. Small air flow-through apertures 123 are punched, or otherwise formed, through the thickness of only the embedded portions of the air impermeable wrapper which define the walls of the groove 120 in a region "B" generally at the mouth end 116 of the filter.

As illustrated in FIG. 13, at least one aperture 123 is formed in each groove substantially immediately adjacent to the mouth end 116 of the filter. The aperture 123 advantageously has a diameter of about 0.06 filter diameters, or ½ mm for conventionally sized filters which are about 8 mm in diameter.

As illustrated in FIG. 13, the aperture 123 in each groove is advantageously spaced from the mouth end 116 of the filter 110 a distance generally corresponding to approximately one-fourth to approximately one-half filter diameters and has a diameter of approximately equal to about 0.06 filter diameters. For conventionally sized cigarette filters, which typically have a diameter of approximately 8 mm, it has been determined that an aperture 123 in each groove 120 located between approximately 2 mm to approximately 4 mm from the mouth end 116 of the filter 110 and having a diameter of approximately ½ mm works well to provide a flow-path for ventilating air from the grooves 120 into the filter rod 112 under certain smoking conditions. It should be clearly understood that a plurality of apertures can be formed in each groove instead of one aperture 123 as illustrated. However, when more than one aperture is formed in each groove, the total flow-through area provided by the plurality of apertures should provide for approximately an equal volume rate of ventilating air flow as is provided for by the aperture 123.

Figure 14:
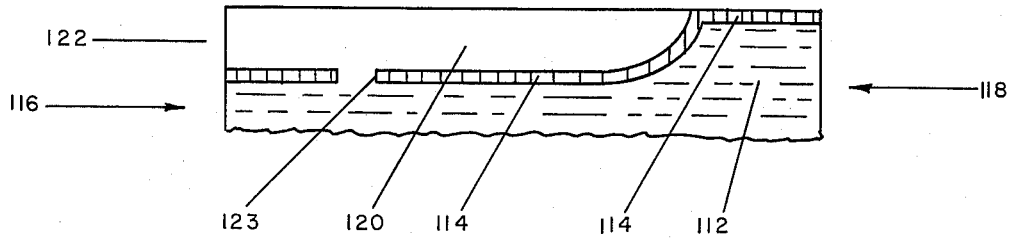
FIG. 14 is an enlarged longitudinal cross-sectional view taken in the direction of arrows 14—14 in FIG. 12 and illustrating an advantageous embodiment of a feature thereof.
Figure 15:
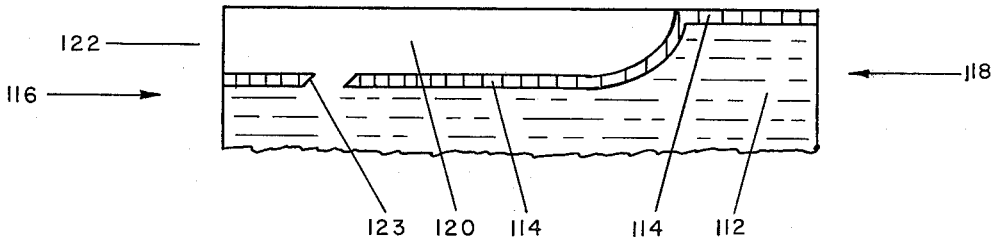
FIG. 15 is an enlarged longitudinal cross-sectional view taken in the direction of an arrow 15—15 in FIGS. 12 and 13 illustrating another advantageous embodiment of a feature thereof.

FIGS. 14 and 15 illustrate alternative advantageous embodiments of the aperture 123 formed through the thickness of the wrapper 114 in a groove 120. In FIG. 14, the aperture 123 is shown having its central axis substantially perpendicular to the longitudinal axis of the filter rod 112. In FIG. 15 the aperture 123 is illustrated as having its central axis slanted at an acute angle to the longitudinal axis of the filter rod 112, that is, slanting from the wall of the groove 120 to the interface of the wrapper 114 and the filter rod 112 in the general direction of the flow of smoke through the filter rod 112.

Figure 16:
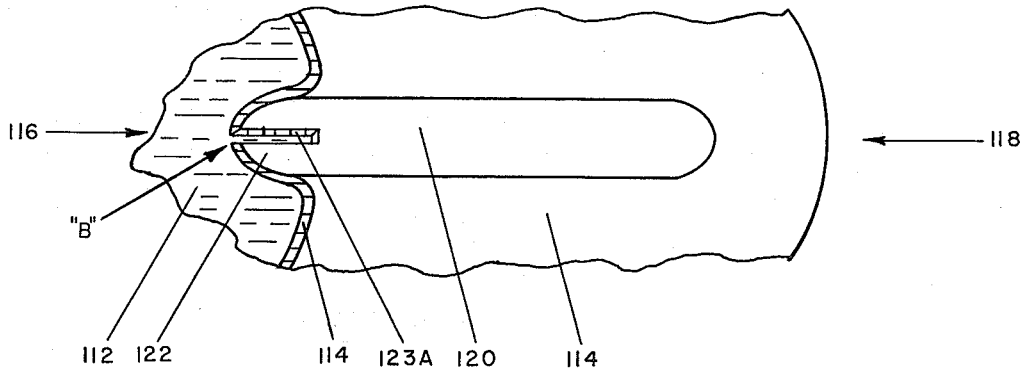
FIG. 16 is an enlarged perspective view of a portion of the filter of FIG. 7 illustrating still a further advantageous embodiment of the ventilating groove thereof; and, FIG. 17 is an enlarged perspective view of a portion of the filter of FIG. 7 illustrating a still further advantageous embodiment of the ventilating groove thereof.

FIG. 16 shows another advantageous embodiment of the cigarette filter 110 wherein a small slit **123*a* is formed through the thickness of only the embedded portions of the air impermeable wrapper which define the walls of the grooves 120 in the region "B" at the mouth end 116 of the filter. As illustrated, the slit 123*a* in each groove is open at one end to the mouth end 116 of the filter and extends therefrom generally longitudinally of the groove for a distance corresponding to from about one-fourth to about one-half a filter diameter. Advantageously, each slit 123*a*** is approximately equal to 0.06 of a filter diameter in width and is of substantially uniform width along its length.

Figure 17:
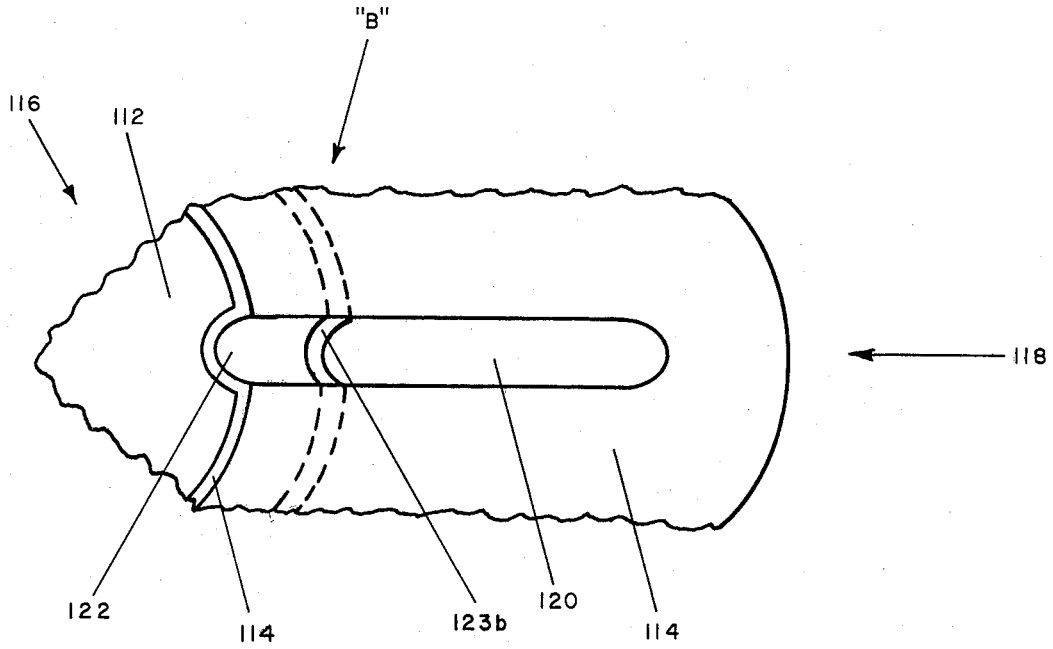

FIG. 17 illustrates a further advantageous embodiment of the cigarette filter 110 wherein at least one circumferentially extending slit **123*b* is formed through the thickness of the wrapper 114 in each groove 120. The circumferentially extending slits 123*b* are preferably located in the region "B" spaced from the mouth end 116 of the filter by a distance corresponding to approximately one-fourth to approximately one-half filter diameters. Preferably, the slits 123*b* have a width approximately equal to about 0.06 filter diameters. If more than one circumferentially extending slit 123*b* is formed in each groove, they should be grouped within the region "B" and provide a flow-through volume rate of ventilating air flow approximately equal to the volume rate of flow provided by the illustrated single circumferentially extending slit 123*b***.

As a manufacturing expedient, it is foreseeable that a circumferential slit be formed through the wrapper 114 entirely around the filter rod 112 and that those portions of the slit outside of the grooves 120 (indicated by the dotted line in FIG. 17) be sealed. This sealing can be accomplished with a coating of a water insoluble solution such as ethylcellulose or a water soluble solution such as sodium CMC or methyl cellulose.

As can best be seen in FIG. 9, the filter rod 112 is attached to a tobacco column 124 with a tipping material 126 which circumscribes the wrapper covered filter rod 112 to form a filtered cigarette 128. The tipping material 126 is air permeable in a zone thereof which overlays the grooves 120 so that ventilating air will flow through it into the grooves 120. Preferably, the tipping material 126 is air permeable only near the closed ends of the grooves 120, i.e. that end of each groove opposite its open end 122 at the mouth end 116 of the filter rod 112. To accomplish this, the tipping material 126 is illustrated as having small flow-through ventilating air perforations 130 which communicate with the grooves 120 preferably near the closed end of the grooves. As a manufacturing expedient, the perforations 130 can be arranged in a spaced apart circumferential array around the wrapped filter rod 112 in which case some of the perforations may overlay the wrapped filter rod in the areas between the grooves 120. However, ventilating air will flow only into the grooves 120 because the wrapper 114 outside of the grooves is air impermeable.

When a smoker draws on the mouth end 116 of the filter 110 while smoking the cigarette 128, ventilating air is drawn into the grooves 120 through the ventilating perforations 130 in the tipping material 126 and travels along the grooves 120 directly to the open end 122 of the groove 120 at the mouth end 116 of the filter rod 112. If, however one or more of the open ends 122 of the grooves 120 becomes blocked, the ventilating air in the blocked groove will pass from the blocked groove through the air permeable embedded wall of the blocked groove through the porous region "A" in the embodiment of FIGS. 10 and 11, and through the apertures 123 in the region "B" in the embodiment of FIGS. 12 and 13, or through the slits **123*a* and 123*b* in the region "B" in the embodiment of FIGS. 16 and 17 and into the filter rod 112 where it co-mingles with and dilutes the smoke flowing through the filter rod from the tobacco column. Even if some of the grooves become blocked resulting in the ventilating air in the blocked groove flowing into the filter rod 112, as discussed immediately above, the ventilating air flowing in the remaining unblocked grooves travels therethrough directly to the open end 122 of the unblocked grooves at the mouth end 116 of the filter rod 112**.

The foregoing details of the present invention are given primarily for clearness of understanding and no unnecessary limitations should be understood therefrom for modifications will become obvious to one skilled in the art upon reading this disclosure and can be made without departing from the spirit of the invention and scope of the appended claims.

The invention claimed is:

1. A filter for a cigarette comprising:

a porous filter rod of generally cylindrical configuration;

an air impermeable wrapper extending longitudinally along said filter rod from one end thereof to the other end and circumscribing said rod leaving flow-through opposed ends of said filter rod;

said wrapper being formed with at least one groove embedded into said filter rod, said at least one groove being open at one end of said filter rod and extending therefrom in a generally longitudinally direction of said filter rod for a distance less than the length of said filter rod;

air permeable means formed through the wall of said at least one groove defined by the embedded portions of said wrapper over substantially the entire length of said groove, the rest of the peripherial surface of said wrapper outside of said at least one groove being air impermeable; and tipping material extending longitudinally and circumscribing said wrapped filter rod, said tipping material being air permeable in a zone thereof overlaying said at least one groove.

2. The filter of claim 1 wherein said tipping material is air permeable only near the closed end of said at least one groove.

3. The filter of claim 1 wherein said tipping material is made air permeable by means of perforations formed therethrough.

4. The filter of claim 1 wherein said air-permeable means formed through the wall of said at least one groove defined by the embedded portions of said wrapper is formed with apertures over substantially the entire length of said at least one groove.

5. The filter of claim 1 wherein said filter rod wrapper is fabricated of air permeable material;

the entire surface of said wrapper including the wall of said at least one groove defined by embedded portions of said wrapper is treated rendering it air impermeable; and, said air permeable means formed through the wall of said at least one groove defined by the embedded portions of said wrapper comprises an array of apertures over substantially the entire length of said at least one groove.

6. The filter of claim 1, wherein said air permeable means formed through the wall of said at least one groove defined by the embedded portion of said wrapper comprises the wall being porous over substantially the entire length of said at least one groove.

7. The filter of claim 1 wherein said filter rod wrapper is fabricated of an air permeable material; and, the peripherial surface of said wrapper, excluding the wall of said at least one groove defined by the embedded portions of said wrapper is treated rendering it air impermeable and leaving the wall of said at least one groove air permeable substantially the entire length of said at least one groove.

8. The filter of claim 5 or 7 wherein said wrapper is treated by heat sealing.

9. The filter of claim 5 or 7, wherein said wrapper is treated with a coating of a water-insoluble material.

10. The filter of claim 1, wherein said at least one groove comprises a plurality of grooves spaced from each other circumferentially of said filter rod.

11. The filter of claim 1 wherein said air permeable means includes a slit in the wall of the at least one groove extending from the open end of the groove a distance substantially the length of the at least one groove.

12. A filter for a cigarette comprising:

a porous filter rod of generally cylindrical configuration;

an air impermeable wrapper extending longitudinally along said filter rod from one end thereof to the other end and circumscribing said rod leaving flow-through opposed ends of said filter rod;

said wrapper being formed with at least one groove embedded into said filter rod, said at least one groove being open at the mouth end of said filter rod and extending therefrom in a generally longitudinally direction of said filter rod for a distance less than the length of said filter rod;

air permeable means formed through the wall of said at least one groove defined by the embedded portion of said wrapper in a region generally at the mouth open end of said at least one groove, the remaining area of said groove and the peripherial surface of said wrapper being air impermeable; and tipping material extending longitudinally of and circumscribing said wrapped filter rod, said tipping material being air permeable in a zone thereof overlaying said at least one groove.

13. The filter of claim 12 wherein said air permeable means is located immediately adjacent the mouth end of said filter rod.

14. The filter of claim 12 wherein said air permeable means is adjacent to and spaced a predetermined distance from the mouth end of said filter rod.

15. The filter of claim 13 wherein said tipping material is air permeable near the end of said at least one groove opposite said end thereof.

16. The filter of claim 13 wherein said tipping material is made air permeable by means of perforations formed therethrough.

17. The filter of claim 13 wherein said air permeable means formed in the wall of said at least one groove defined by the embedded portion of said wrapper comprises at least one flow-through aperture generally adjacent the open end of said at least one groove.

18. The filter of claim 17, wherein the longitudinal axis of said at least one flow-through aperture is generally perpendicular to the longitudinal axis of said filter rod.

19. The filter of claim 17, wherein the longitudinal axis of said at least one flow-through aperture is at an acute angle to the longitudinal axis of said filter rod slanted in the general direction of the flow of smoke through said filter rod.

20. The filter of claim 13 wherein said air permeable means comprises a slit open at one of its ends to the mouth end of said filter rod and extending therefrom longitudinally of said groove for a distance of between approximately one-fourth to approximately one-half filter diameters.

21. The filter of claim 13 wherein said air permeable means comprises a least one circumferentially extending slit, said at least one slit being spaced from the mouth end of said filter rod by a distance of between approximately one-fourth to one-half filter diameters.

22. The filter of claim 13 wherein:

said filter rod wrapper is fabricated of air permeable material;

the entire surface of said wrapper including the wall of said at least one groove defined by embedded portions of said wrapper is treated rendering it air impermeable; and, said air permeable means formed in the wall of said at least one groove defined by the embedded portions of said wrapper comprises at least one flow-through aperture generally adjacent the open end of said at least one groove.

23. The filter of claim 13 wherein said air permeable means formed through the wall of said at least one groove defined by the embedded portion of said wrapper comprises a porous region generally adjacent the open end of said at least one groove.

24. The filter of claim 13 wherein:

said filter rod wrapper is fabricated of an air permeable material; and, the peripherial surface of said wrapper, and a portion of the wall of said at least one groove defined by the embedded portions of said wrapper is treated rendering it air impermeable and leaving the wall of said at least one groove untreated and therefore air permeable in an area generally adjacent the open end of said at least one groove.

* * * * *